US009559438B2

(12) United States Patent
Keswani

(10) Patent No.: US 9,559,438 B2
(45) Date of Patent: Jan. 31, 2017

(54) CONNECTOR ASSEMBLY FOR ESTABLISHING AN ELECTRICAL CONNECTION WITH WIRES

(71) Applicant: IDEAL Industries, Inc., Sycamore, IL (US)

(72) Inventor: Sushil N. Keswani, Sycamore, IL (US)

(73) Assignee: IDEAL Industries, Inc., Sycamore, IL (US)

( * ) Notice: Subject to any disclaimer, the term of this patent is extended or adjusted under 35 U.S.C. 154(b) by 0 days.

(21) Appl. No.: 14/837,624

(22) Filed: Aug. 27, 2015

(65) Prior Publication Data

US 2015/0364839 A1 Dec. 17, 2015

Related U.S. Application Data

(62) Division of application No. 13/456,315, filed on Apr. 26, 2012, now Pat. No. 9,149,858.

(60) Provisional application No. 61/480,605, filed on Apr. 29, 2011.

(51) Int. Cl.

| | |
|---|---|
| ***H01R 11/20*** | (2006.01) |
| ***H01R 4/24*** | (2006.01) |
| ***H01R 4/26*** | (2006.01) |
| ***B21F 15/06*** | (2006.01) |

(52) U.S. Cl.

CPC ..... *H01R 4/2475* (2013.01); *B21F 15/06* (2013.01); *H01R 4/2404* (2013.01); *H01R 4/2433* (2013.01)

(58) Field of Classification Search

CPC ..... B21F 15/06; H01R 4/2433; H01R 4/2404; H01R 4/2475; H01R 4/24

USPC ..... 439/416, 775, 387, 404

See application file for complete search history.

(56) References Cited

U.S. PATENT DOCUMENTS

| | | | |
|---|---|---|---|
| 3,594,703 | A | 7/1971 | Holtzapple |
| 4,350,404 | A | 9/1982 | Clark et al. |
| 4,679,878 | A | 7/1987 | Volk |
| 5,141,449 | A | 8/1992 | Tieszen |
| 5,498,172 | A | 3/1996 | Noda |
| 5,611,709 | A | 3/1997 | McAnulty |
| 5,704,811 | A | 1/1998 | Hsu |
| 6,102,745 | A | 8/2000 | Schultz et al. |

(Continued)

FOREIGN PATENT DOCUMENTS

| | | | |
|---|---|---|---|
| DE | 20114781 | U1 | 12/2001 |
| JP | 2005-149935 | A | 6/2005 |

OTHER PUBLICATIONS

ISA/US, International Search Report and Written Opinion of PCT Application No. US2012/035372, date of completion Jul. 19, 2012, 12 pgs.

(Continued)

*Primary Examiner* — Javaid Nasri

(74) *Attorney, Agent, or Firm* — Greenberg Traurig, LLP

(57) ABSTRACT

A connector assembly for connecting a first pair of wires associated with a DC power source to a second pair of wires associated with a DC powered device. The connector assembly includes a run portion having insulation piercing contacts for electrically engaging the first pair of wires. A tap portion of the connector assembly may also include insulation piercing contacts for electrically engaging the second pair of wires. The run portion and the tap portion may be provided in separate housing assemblies that are releasably engageable or may be provided in an integrated housing assembly.

10 Claims, 9 Drawing Sheets

(56) References Cited

U.S. PATENT DOCUMENTS

| | | | | |
|---|---|---|---|---|
| 6,159,035 | A | 12/2000 | Smith, III | |
| 6,280,209 | B1 | 8/2001 | Bassler et al. | |
| 7,267,571 | B1 | 9/2007 | Twigg et al. | |
| 2004/0142592 | A1 | 7/2004 | Peng | |
| 2004/0209511 | A1 | 10/2004 | Liao | |
| 2005/0287863 | A1 | 12/2005 | Tufano et al. | |
| 2006/0178035 | A1* | 8/2006 | Shimirak | H01R 4/12 439/404 |
| 2007/0123091 | A1 | 5/2007 | Swedberg et al. | |
| 2008/0081507 | A1 | 4/2008 | Mahajan | |
| 2008/0278898 | A1 | 11/2008 | Huang | |
| 2009/0181580 | A1 | 7/2009 | Bethurum et al. | |

OTHER PUBLICATIONS

European Patent Office, extended European search report issued on EP patent application No. 12777224.2, dated Aug. 14, 2014, 7 pages.

Chinese Patent Office, Office Action issued on Chinese patent application No. 201280021009.X, dated Jul. 2, 2015, 13 pages.

Chinese Patent Office, 2nd Office Action issued on Chinese patent application No. 201280021009.X, received Feb. 25, 2016, 6 pages.

* cited by examiner

CONNECTOR ASSEMBLY FOR ESTABLISHING AN ELECTRICAL CONNECTION WITH WIRES

RELATED APPLICATION INFORMATION

This application claims the benefit of and is a divisional of U.S. application Ser. No. 13/456,315, filed on Apr. 26, 2012, which application claims the benefit of U.S. Provisional Application No. 61/480,605, filed on Apr. 29, 2011, the disclosures of which are incorporated herein by reference in its entirety.

BACKGROUND

Assemblies for tapping into electrical wires are generally known. By way of example, U.S. Pat. No. 6,159,035 describes a connector assembly for penetrating the insulation and establishing an electrical connection with insulated electrical wires or conductors, thereby eliminating the need to strip the insulation away from the insulated wires. U.S. Pat. No. 3,594,703 describes an electrical tapoff connector having an insulation-piercing screw means which, when tightened onto an insulated line cable, pierces the insulation of the cable and mechanically and electrically engages the conductor thereof. U.S. Pat. No. 5,141,449 describes a snap-on light socket having sharply pointed portions which function to pierce the insulation of a wire to effect an electrical connection. U.S. Pat. No. 5,611,709 describes an assembly for electrically and mechanically connecting one or more flexible conductive members with one or more insulated wires using one or more insulation piercing terminals.

While such assemblies generally work for their intended purpose, a need exists for an improved assembly, particular one which may be used in connection with low voltage DC power systems.

SUMMARY

Described hereinafter are improved connector assemblies useful, for example, to provide a means to connect various DC devices (e.g., LED light fixtures, alarm systems, cameras, sensors, etc.) to a low voltage DC power source. More particularly, in these DC applications there is always a positive (+) and negative (−) wire for the DC voltage. The pair of wires are most often in an outer jacket but can be a pair of wires running together that are not in a jacket. The subject connector assemblies provide a relatively simpler method for attaching DC powered devices to such wires.

By way of example only, the connector assembly may include a "run" side connector that is releasably matable with a "tap" side connector. The "run" side connector is adapted to be mechanically and electrically coupled to the pair of wires through the use of insulation piercing contacts. While insulation piercing contacts are provided on the "run" side connector, the pair of wires to which the "run" side connector is to be mated may have an outer jacket or may not and may be twisted or not twisted without limitation. The "tap" side connector is then adapted to receive a further pair of wires, e.g., a pair of wires used to provide DC power to one or more DC devices. In this regard, the "tap" side connector may also utilize insulation piercing contacts whereby the further pair of wires need not be stripped in order to make a connection therewith. The "tap" side connector could alternatively utilize push-in connectors, weld connectors, or other connectors as required without limitation. The "tap" side connector, in cooperation with the "run" side connector, thus allows a user to tapoff of the "run" also using a twisted pair or untwisted 2-conductor wire with or without an outer jacket.

While one described embodiment utilizes a "run" connector and a "tap" connector that are adapted to be releasably matable using, for example, a spring contact in each of the "run" connector and the "tap" connector which are also arranged to be engaged, in other embodiment the "run" connector and the "tap" connector are integrated into an integrated housing assembly. In both embodiments, however, the connector assembly is designed to be press-fit over the wires where only a pair of pliers or the like need be used to compress the insulation piercing connectors onto the wires.

While the foregoing provides a general description of the subject connector assemblies, a better understanding of the objects, advantages, features, properties, and relationships of the subject connector assemblies will be obtained from the following detailed description and accompanying drawings which set forth illustrative embodiments and which are indicative of the various ways in which the principles of the invention may be employed.

BRIEF DESCRIPTION OF THE DRAWINGS

For a better understanding of the hereinafter described connector assemblies, reference may be had to the following drawings in which.

DETAILED DESCRIPTION

Figure 1:
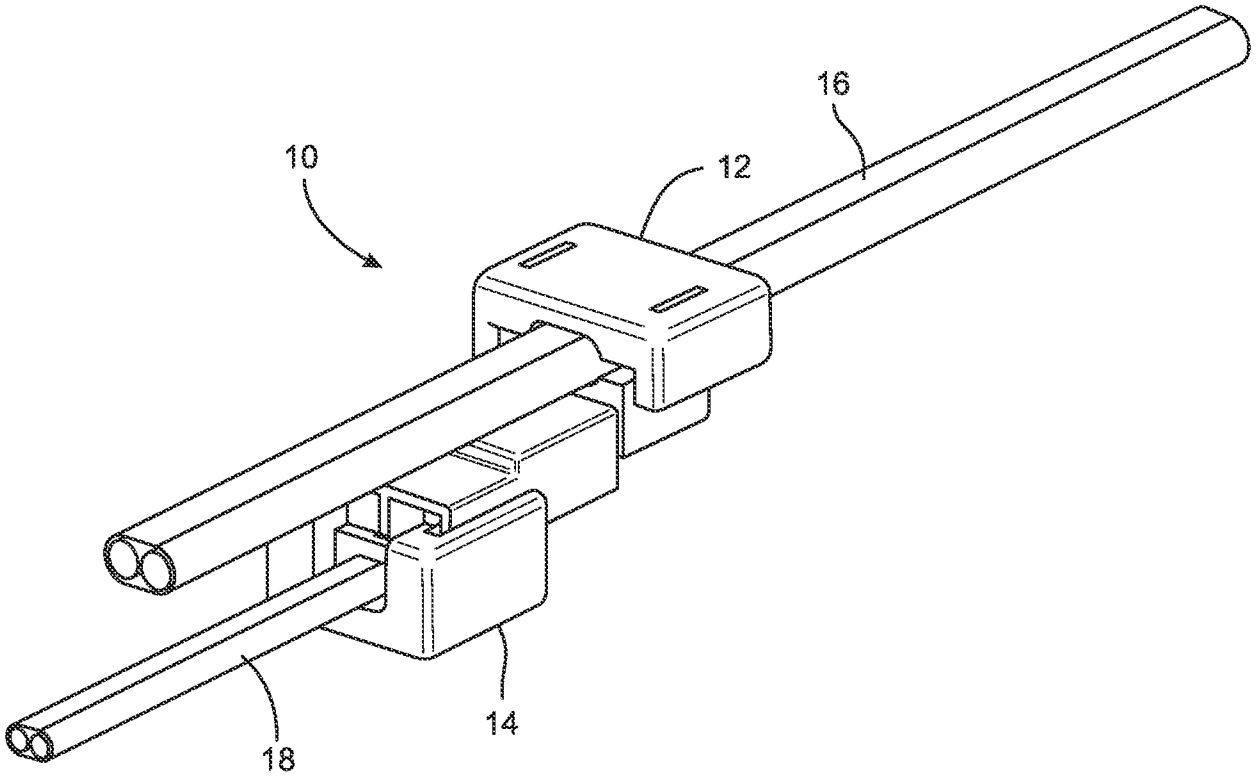
FIG. 1 illustrates a first exemplary connector constructed according to the description that follows.

Turning now to the Figures, illustrated are various embodiments of a connector assembly useful, for example, to provide a means to connect various DC devices (e.g., LED light fixtures, alarm systems, cameras, sensors, etc.) to a low voltage DC power source. By way of first example, shown in FIGS. 1-6, the connector assembly 10 includes a "run" side connector assembly 12 and a "tap" side connector assembly 14. The "run" side connector assembly 12 is adapted to be mechanically and electrically connected to a first wire pair 16 while the "tap" side connector assembly 14 is also adapted to be mechanically and electrically connected to a second wire pair 18. The first wire pair 16 may be 14 to 12 AWG wires leading to a DC power source while the second wire pair 18 may be 16 to 18 AWG wires leading to a DC powered device. It will be understood, however, that other wire gauges could be utilized and, as such, these examples are not intended to be limiting. Furthermore, the first wire pair 16 and the second wire pair 18 may have an outer jacket or may not and may be twisted or untwisted.

When utilized with twisted wires, it is contemplated that the wires would be untwisted prior to insertion into a respective one of the connectors 12/14.

Figure 2:
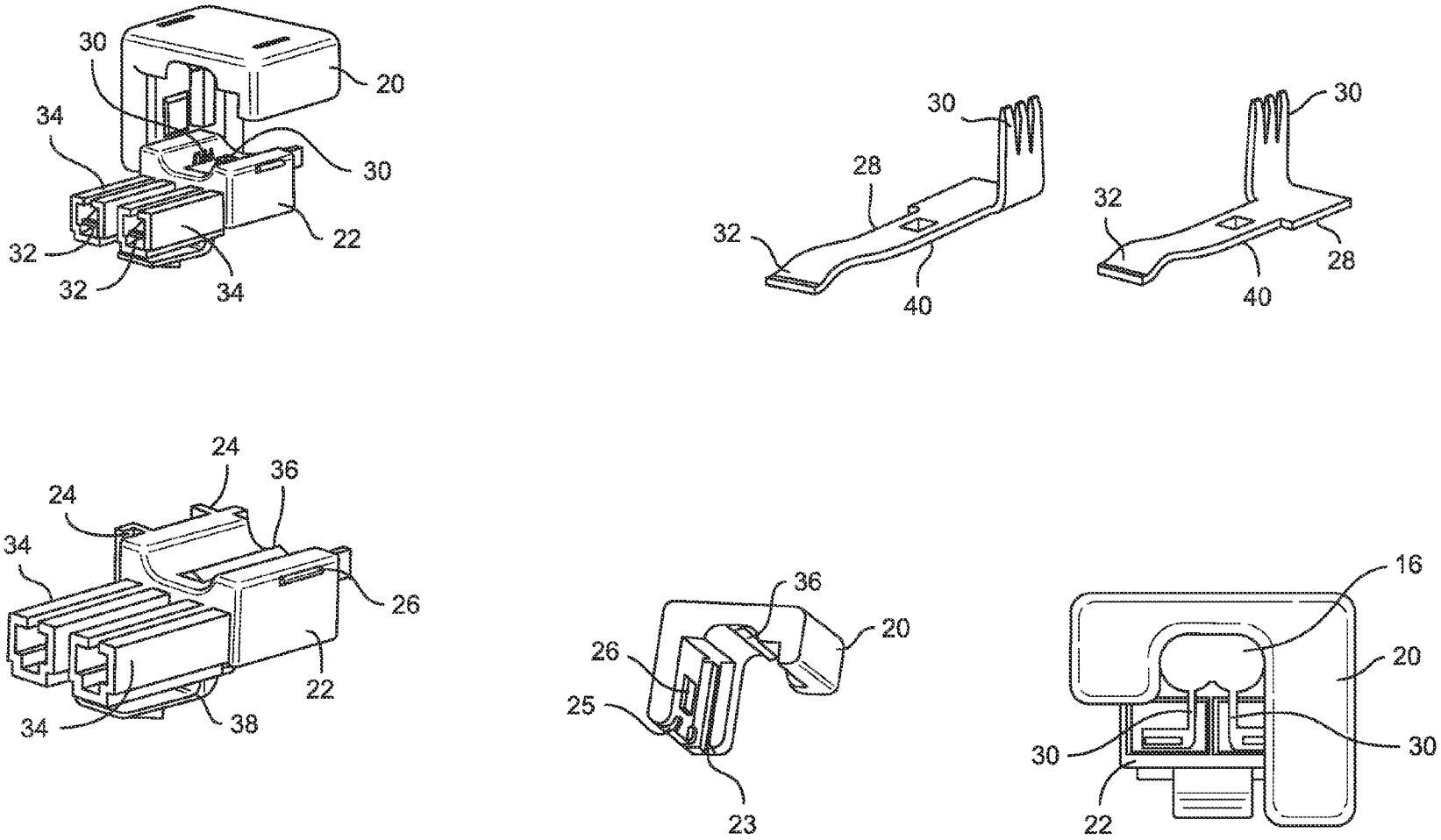
FIGS. 2 and 3 illustrate an exemplary "run" side component of the exemplary connector illustrated in FIG. 1.
Figure 3:
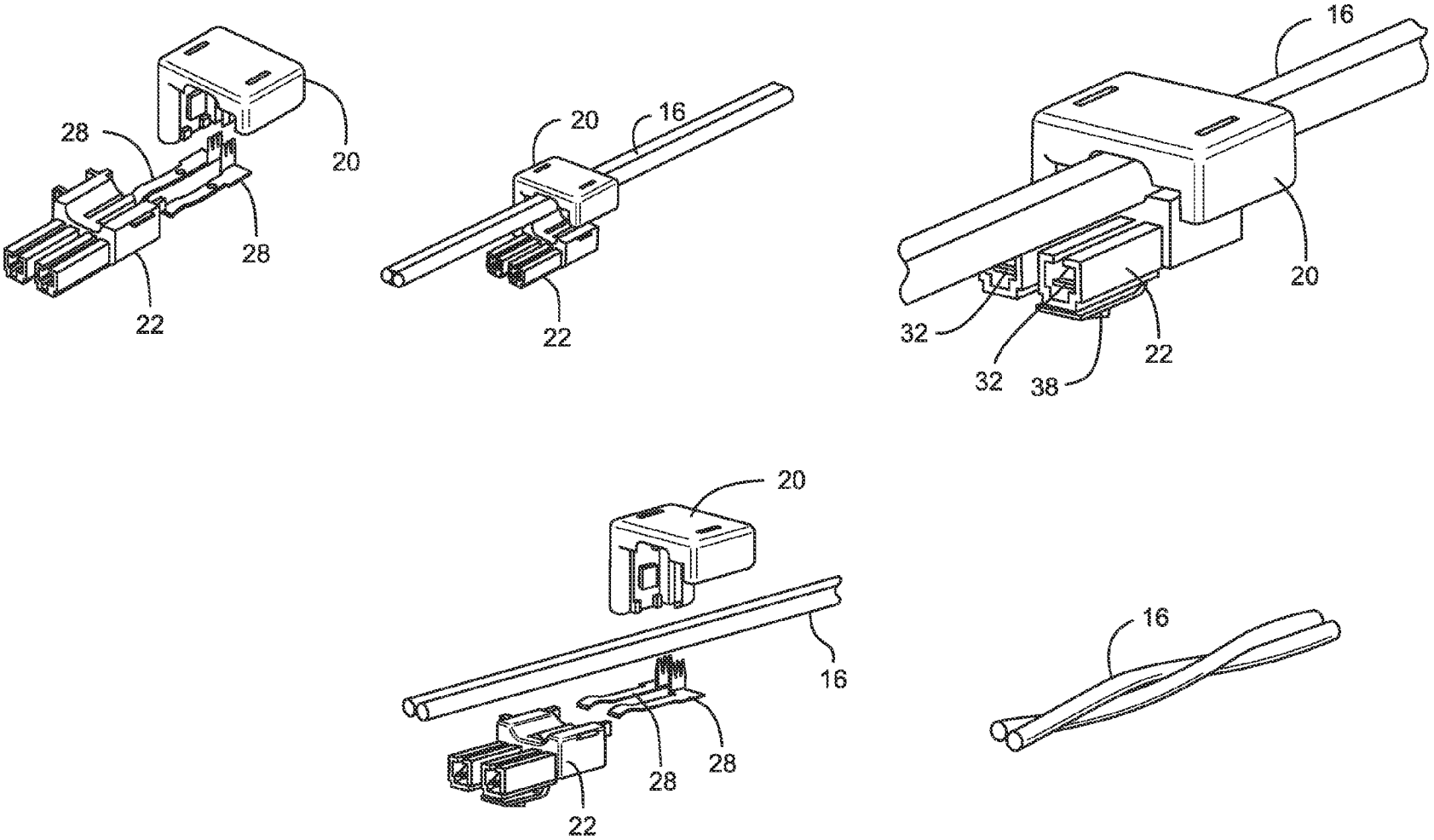

For mechanically and electrically coupling the "run" side connector assembly 12 to the first wire pair 16, the "run" side connector assembly 12 comprises a first housing section 20 which is moveably engaged with and lockable with respect to a second housing section 22, as particularly illustrated in FIG. 2. To provide the movable engagement between the first housing section 20 and the second housing section 22, the second housing section 22 may include tabs 24 that are adapted to engage with, and slide within, corresponding grooves 23 formed in the first housing section 20. Other arrangements for slidably connecting, hingedly connecting, or the like the two housing components 20 and 22 for the purpose of allowing the first wire pair 16 to be disposed therebetween and to then allow the two housing components 20 and 22 to be compressed to thereby trap and engage the first wire pair 16 within the "run" side connector assembly 12 are also contemplated. While not required, a stop feature 25 may also be provided to inhibit separation of the two housing components 20 and 22 when the two housing components 20 and 22 are interconnected and readied for engagement with the first wire pair 16. To lock the first housing section 20 and the second housing section 22 together once the housing sections 20 and 22 have been brought together upon the first wire pair 16, cooperating movement inhibiting mechanisms, such as bumps 26 or the like, may be provided to each of the first and second housing components 20 and 22.

To electrically and mechanically engage the first wire pair 16 when the "run" side connector 12 is compressed upon the first wire pair 16, the second housing component 22 is provided with a pair of insulation piercing contacts 28 having at one end thereof a piercing tine 30 having one or more piercing tips and having at the second end thereof a spring disconnect interface 32 which is provided to engage with a corresponding spring disconnect interface provided to contacts within the "tap" side connector 14 as described hereinafter. When the insulation piercing contacts 28 are arranged within the second housing component 22, the disconnect interface 32 of each contact 28 will be positioned within a male housing extension 34 (over which female housing extensions of the "run" side connector 14 are to be positioned) while the tines 30 of the contacts 28 will be positioned so as to extend into a wire receiving chamber formed between the two housing component 20 and 22, e.g., an area that is formed between opposed surfaces of the housing components 20 and 22. In this manner, when the first housing component 20 and the second housing component 22 are compressed upon the first wire pair 16, for example via use of pliers or the like, the first wire pair 16 will be forced upon the tines 30 of the contacts 28 and the tines 30 will be caused to pierce the outer jacket (if any) of the wires, the insulation of the wires, and the wires themselves to thereby provide an electrical connection therewith. To support the wires of the first wire pair 16 within the wire receiving chamber, one or both of the first housing component 20 and second housing component 22 may be provided with a rib 36 which is to be positioned on the surfaces forming the wire receiving chamber along a line that generally separates the wires in the first wires pair 16. The second housing component 22 may also be provided with a first half of a latching component 38 which is adapted to releasably engage with a corresponding second half of a latching component that is to be provided to the "tap" side connector 14. Furthermore, the contacts 28 may be provided with barbs 40 or the like engageable with like components formed in the second housing component 22 to thereby lock the contacts 28 in place when the contacts 28 are inserted into the second housing component 22.

Figure 4:
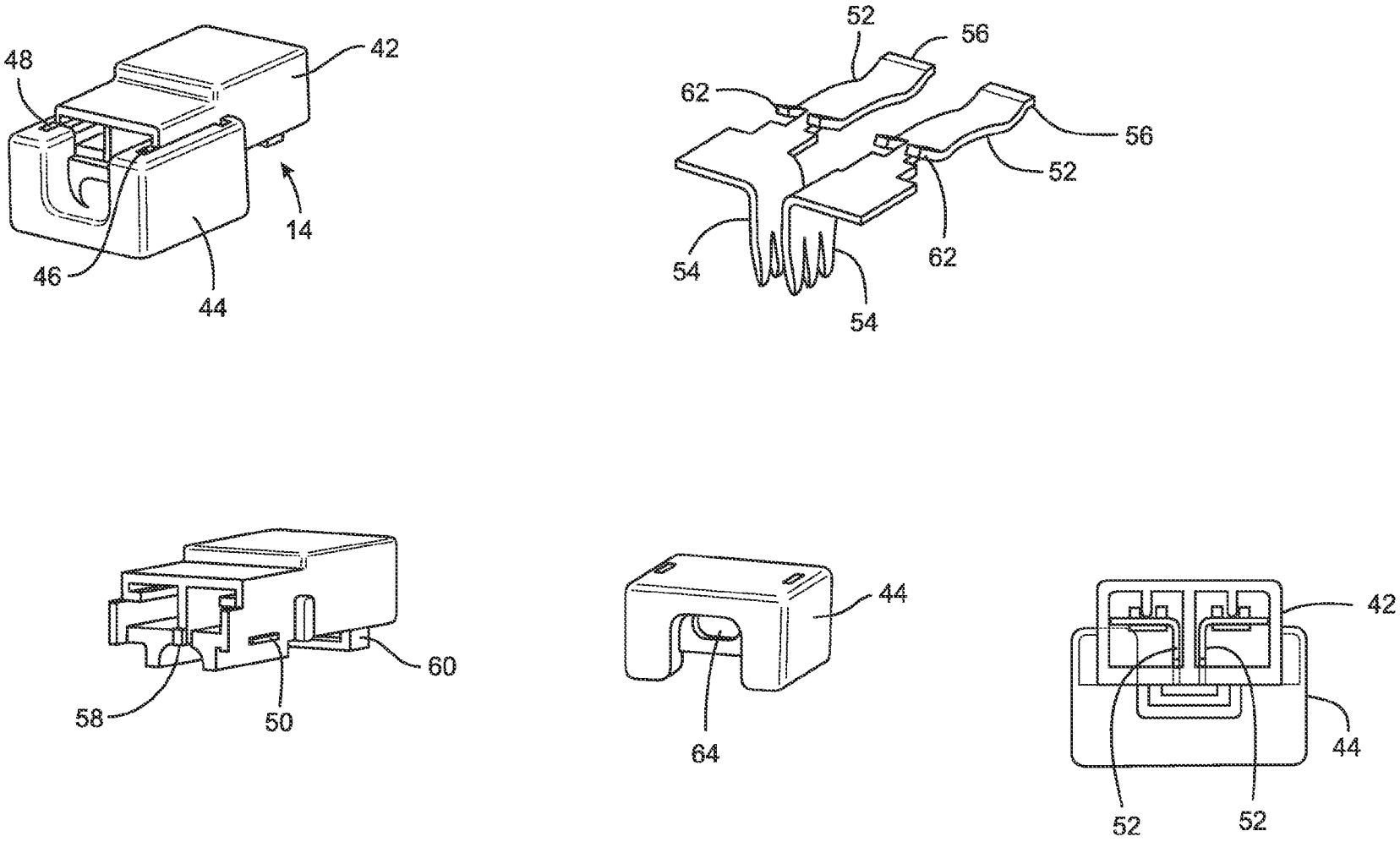
FIGS. 4 and 5 illustrate an exemplary "tap" side component of the exemplary connector illustrated in FIG. 1.
Figure 5:
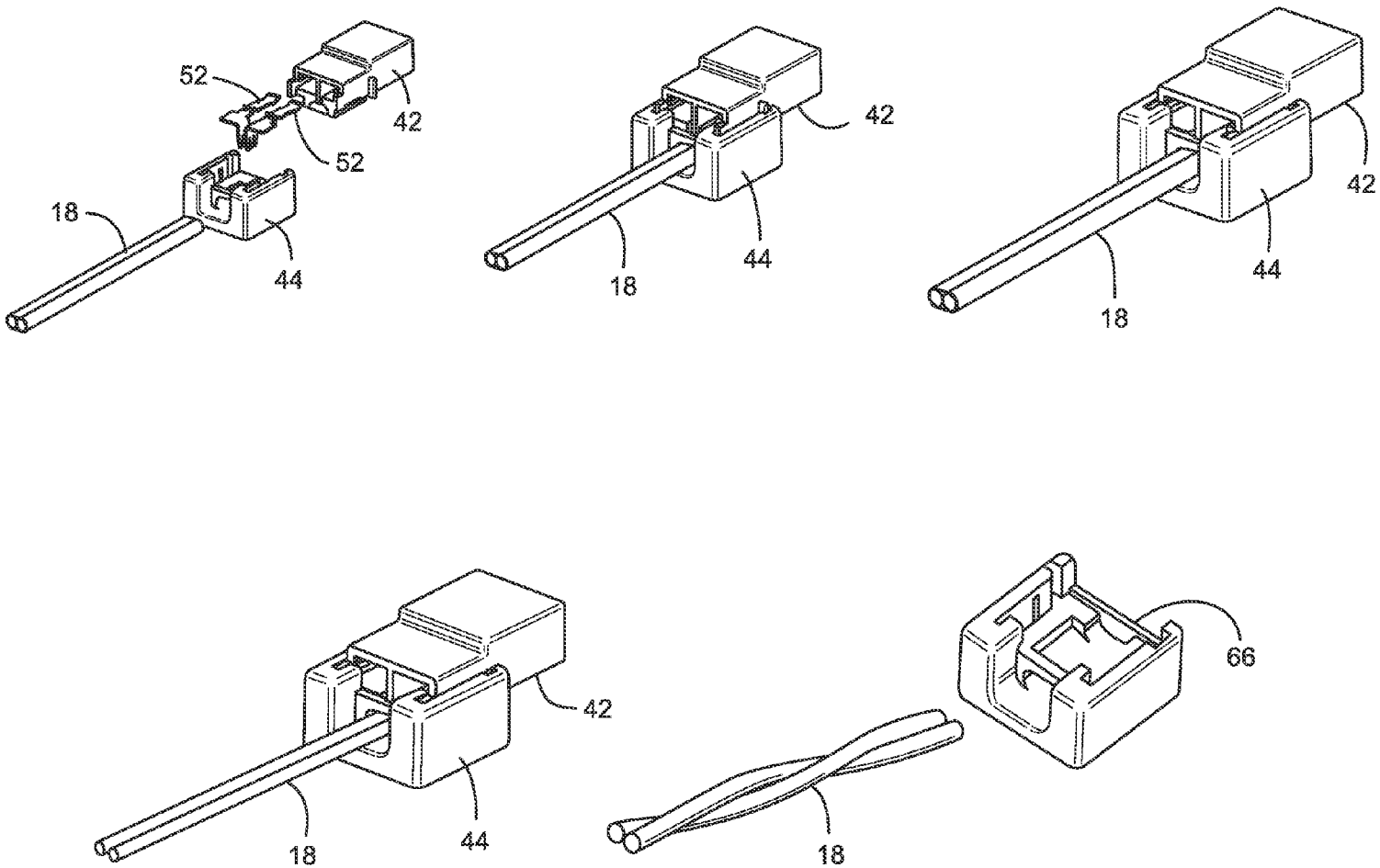

For mechanically and electrically coupling the "tap" side connector assembly 14 to the second wire pair 18, the "tap" side connector assembly 14 likewise comprises a first housing section 42 which is moveably engaged with and lockable with respect to a second housing section 44, as particularly illustrated in FIG. 4. To provide the movable engagement between the first housing section 42 and the second housing section 44, the first housing section 42 may include tabs 46 that are adapted to slide within corresponding channels or grooves 48 formed in the second housing section 44. Other arrangements for slidably connecting, hingedly connecting, or the like the two housing components 42 and 44 for the purpose of allowing the second wire pair 18 to be disposed therebetween and to then allow the two housing components 42 and 44 to be compressed to thereby trap and engage the second wire pair 18 within the "tap" side connector assembly 14 are also contemplated. To lock the first housing section 42 and the second housing section 44 together once the housing sections 42 and 44 have been compressed upon the second wire pair 18, cooperating movement inhibiting mechanisms, such as bumps 50 or the like, may be provided to each of the first and second housing components 42 and 44.

Figure 6:
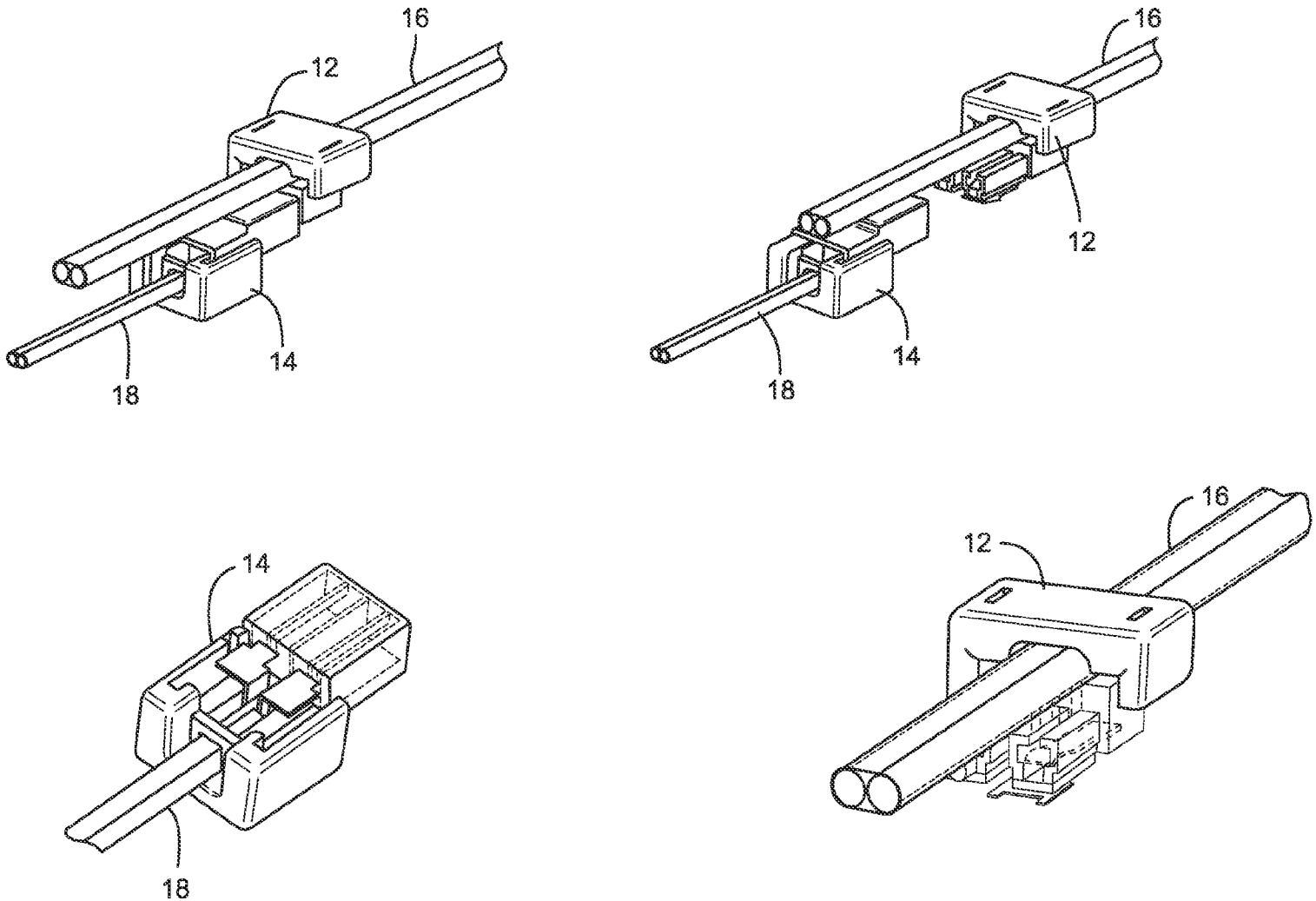
FIG. 6 illustrates an exemplary method for placing the "run" side component and the "tap" side component of the exemplary connector illustrated in FIG. 1 into releasable engagement.

To electrically and mechanically engage the second wire pair 18 when the "tap" side connector 14 is compressed upon the second wire pair 18, the first housing component 42 is provided with a pair of insulation piercing contacts 52 having at one end thereof a piercing tine 54 having one or more piercing tips and having at the second end thereof a spring disconnect interface 56 which is provided to engage with the corresponding spring disconnect interface 32 provided to the contacts 28 within the "run" side connector 12 as described above. When the insulation piercing contacts 52 are arranged within the first housing component 42, the disconnect interface 56 of each contacts 52 will be positioned within a female housing extension (into which the male housing extensions of the "run" side connector 12 are to be positioned) while the tines 54 of the contacts 52 will be positioned so as to extend into a wire receiving chamber formed between the two housing component 42 and 44, e.g., an area that is formed between opposed surfaces of the housing components 42 and 44. In this manner, when the first housing component 42 and the second housing component 44 are compressed upon the second wire pair 18, for example via use of pliers or the like, the second wire pair 18 will be forced upon the times 54 of the contacts 52 and the tines 54 will be caused to pierce the outer jacket (if any) of the wires, the insulation of the wires, and the wires themselves to thereby provide an electrical connection therewith. To support the wires of the second wire pair 18 within the wire receiving chamber, one or both of the first housing component 42 and second housing component 44 may be provided with a rib 58 which is to be positioned on the surfaces forming the wire receiving chamber along a line that generally separates the wires in the second wires pair 18. The first housing component 42 may also be provided with a second half of a latching component 60 which is adapted to releasably engage with a corresponding first half of a latching component 38 that is to be provided to the "run" side connector 12 as above described and as illustrated in FIG. 6. In this regard, it will be appreciated that any form of releasably latching mechanism can be used for this purpose. Furthermore, the contacts 52 may be provided with barbs 62 or the like engageable with like components formed in the first housing component 42 to thereby lock the contacts 52 in place when the contacts 52 are inserted into the first housing component 42. As additionally illustrated in FIGS. 4 and 5, the second housing connector may optionally be provided a wire receiving opening 64 and a wire stop 66.

While the contacts 52 are illustrated and described as being insulation piercing contacts, it will be appreciated that, in other embodiments, the contacts may include other mechanisms for engaging with the wires of the second wire pair 18.

Figure 7:
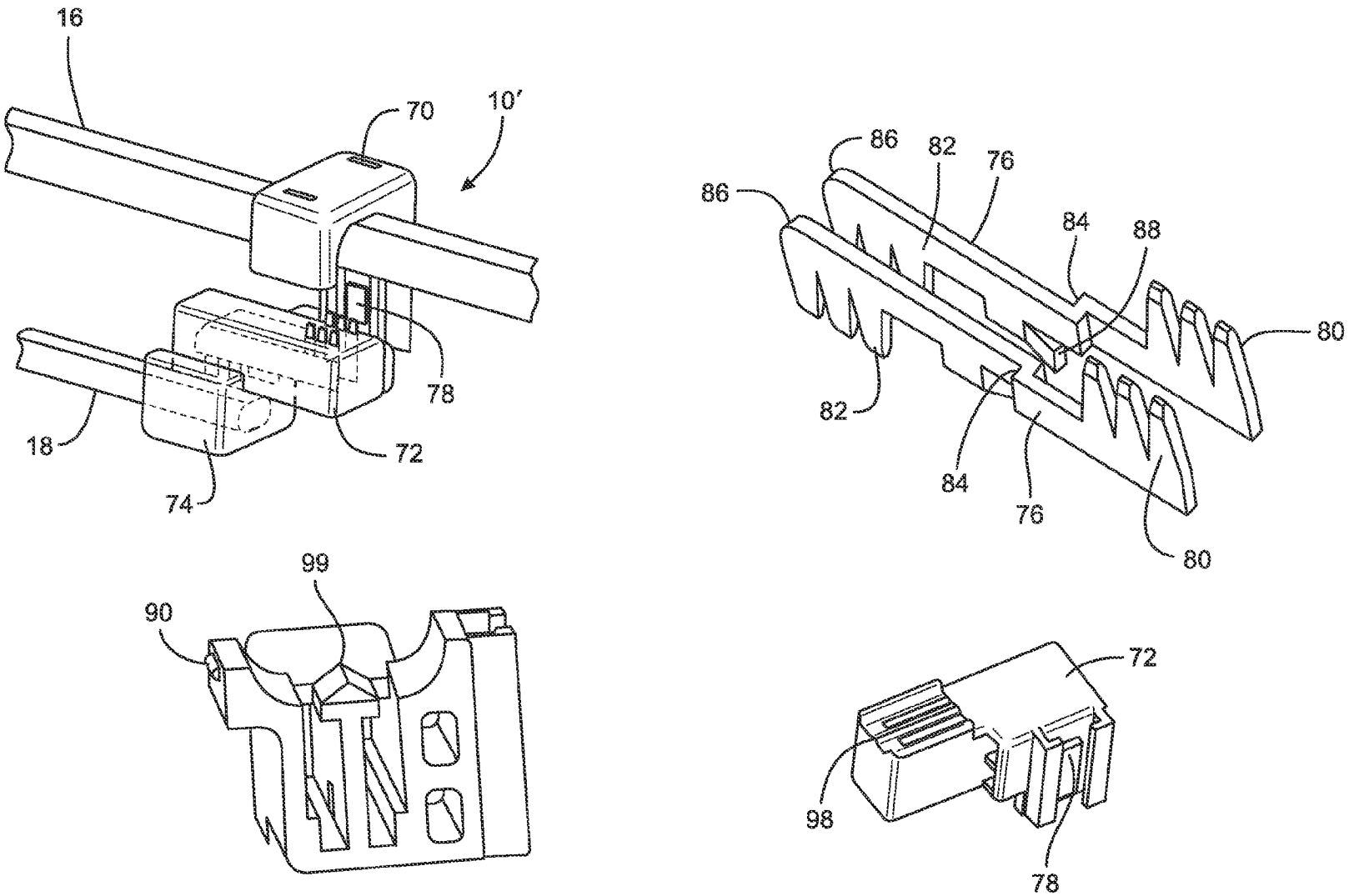
FIGS. 7 and 8 illustrate a second exemplary connector constructed according to the description that follows.
Figure 8:
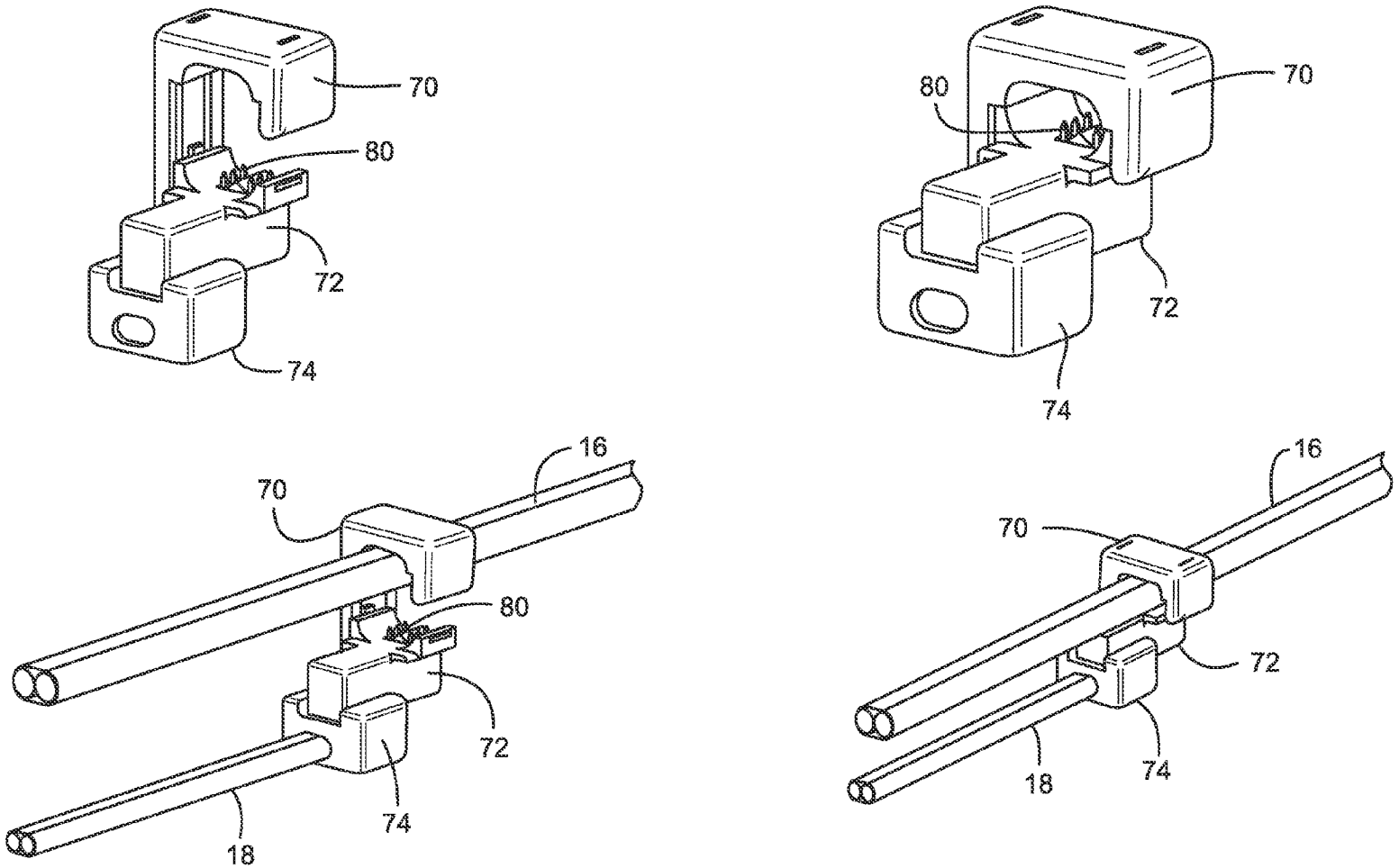

In a second embodiment, illustrated in FIGS. 7 and 8, the connector assembly 10' comprises a first housing component 70, second housing component 72, and third housing component 74. In a manner similar to that describe above, the first housing component 70 and the second housing component 72 cooperate to provide a "run" side connector portion and the third housing component 74 and the second housing component 72 cooperate to provide a "tap" side connector portion. In this example, as described in greater detail below, the second housing component 72 has insulation piercing contacts 76 for engaging with both the first wire pair 16 and the second wire pair 18.

For mechanically and electrically coupling the "run" side connector portion to the first wire pair 16, the first housing section 70 is moveably engaged with and lockable with respect to the second housing section 72, as particularly illustrated in FIGS. 7 and 8. To provide the movable engagement between the first housing section 70 and the second housing section 72, the second housing section 72 and the first housing section 70 may again be provided with cooperating tab and groove structures as described above. Other arrangements for slidably connecting, hingedly connecting, or the like the two housing components 70 and 72 for the purpose of allowing the first wire pair 16 to be disposed therebetween and to then allow the two housing components 70 and 72 to be moved together to thereby engage the first wire pair 16 within the "run" side connector portion are again contemplated. To lock the first housing section 70 and the second housing section 72 together once the housing sections 70 and 72 have been compressed upon the first wire pair 16, cooperating movement inhibiting mechanisms, such as bumps 78 or the like, may be provided to each of the first and second housing components 70 and 72.

To electrically and mechanically engage the first wire pair 16 when the "run" side connector portion is compressed upon the first wire pair 16, the second housing component 72 is provided with a pair of insulation piercing contacts 76 having at one end thereof a piercing tine 80 having one or more piercing tips and having at the second end thereof a further piercing time 82 having one or more piercing tips. As will be described further below, the piercing tine 82 is provided to engage with the second wire pair 18 as part of the "tap" side connector portion of the assembly 10'. Thus, in the event that different gauge wires are used within the first wire pair 16 and the second wire pair 18, the contacts 76 may be provided with a bend or the like 84 to thereby allow the tines to be aligned as required. The contacts 76 may also include a curved portion 86 which will engage with a corresponding surface provided within the second housing 72 to thereby bias or force the tines 82 towards the third housing component 74 when the contacts 76 are inserted into the second housing component 72. When so inserted, the tines 80 of the contacts 76 will be positioned so as to extend into a wire receiving chamber formed between the two housing component 70 and 72, e.g., an area that is formed between opposed surfaces of the housing components 70 and 72, while the tines 82 of the contacts 76 will be positioned so as to extend into a wire receiving chamber formed between the two housing components 74 and 72, e.g., an area that is formed between opposed surfaces of the housing components 74 and 72. Furthermore, the contacts 76 may be provided with barbs 88 or the like engageable with like components formed in the second housing component 72 to thereby lock the contacts 76 in place when the contacts 76 are inserted into the second housing component 72. With this arrangement, when the first housing component 70 and the second housing component 72 are compressed upon the first wire pair 16, for example via use of pliers or the like, the first wire pair 16 will be forced upon the times 80 of the contacts 76 and the tines 80 will be caused to pierce the outer jacket (if any) of the wires, the insulation of the wires, and the wires themselves to thereby provide an electrical connection therewith. To support the wires of the first wire pair 16 within the wire receiving chamber, one or both of the first housing component 70 and second housing component 72 may be provided with a rib 98 which is to be positioned on the surfaces forming the wire receiving chamber along a line that generally separates the wires in the first wires pair 16.

For mechanically and electrically coupling the "tap" side connector portion to the second wire pair 18, the third housing section 74 is moveably engaged with and lockable with respect to a second housing section 74. To provide the movable engagement between the third housing section 74 and the second housing section 72, the third housing section 74 and the second housing section 72 may include cooperating tabs and grooves as described previously. As before, other arrangements for slidably connecting, hingedly connecting, or the like the two housing components 74 and 72 for the purpose of allowing the second wire pair 18 to be disposed therebetween and to then allow the two housing components 74 and 72 to be moved together to thereby trap and engage the second wire pair 18 within the "tap" side connector portion are also contemplated. To lock the third housing section 74 and the second housing section 72 together once the housing sections 74 and 72 have been brought together upon the second wire pair 18, cooperating movement inhibiting mechanisms, such as bumps 90 or the like, may be provided to each of the third and second housing components 74 and 72. Thus, when the third housing component 74 and the second housing component 72 are compressed upon the second wire pair 18, for example via use of pliers or the like, the second wire pair 18 will be forced upon the times 82 of the contacts 76 and the tines 82 will be caused to pierce the outer jacket (if any) of the wires, the insulation of the wires, and the wires themselves to thereby provide an electrical connection therewith. To support the wires of the second wire pair 18 within the wire receiving chamber, one or both of the third housing component 74 and second housing component 72 may be provided with a rib 99 which is to be positioned on the surfaces forming the wire receiving chamber along a line that generally separates the wires in the second wires pair 18.

While the second end of the contacts 76 are illustrated and described as being insulation piercing contacts having tines 82, it will be appreciated that, in other embodiments, the second end of the contacts 76 may include other mechanisms for engaging with the wires of the second wire pair 18.

Figure 9:
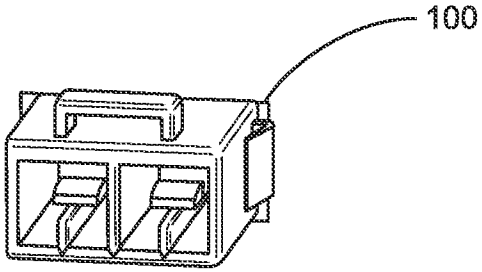
FIG. 9 illustrates a further exemplary embodiment adapted for wall or chassis mounting.

In a yet further embodiment, illustrated in FIG. 9, the connector assembly could be adapted for mounting to a wall or chassis to thereby provide an outlet. For example, the wall or chassis could be provided with a cutout 100 for receiving one of the "run" or "tap" connectors to which the other of the "run" or "tap" connectors could be releasably engaged with as needed. Furthermore, the coupling available via such an outlet could be adapted to engage with other types of connectors as needed for any particular purpose, such as conventional jacks. Still further, the disconnect portion described above could be replaced with a contact bus area to provide a permanent connection. With such an embodiment, one could terminate a "run" wire at the outlet using the above describe "run" connector.

While specific embodiments of the subject invention have been described in detail, it will be appreciated by those skilled in the art that various modifications and alternatives to those details could be developed in light of the overall teachings of this disclosure. For example, it will be appreciated that the "run" portion of the connector assemblies can be at the power supply, e.g., the power supply is provided with a disconnect interface as described above to which the "tap" portion may be releasably engaged. Still further, while the "run" and "tap" portions of the connector assemblies are shown as generally being in-line, it will be appreciated that the "run" and "tap" portions of the connector assemblies can be off-line, e.g., oriented at an angle with respect to one another. It will therefore be appreciated that features described with respect to the various embodiments are not to be limited to any particular embodiment but may be freely used across embodiments where applicable. Additionally, it will be appreciate that the size, shape, arrangement, and/or number of components illustrated and described can be changed as necessary to meet a given need. Accordingly, the particular arrangements disclosed are meant to be illustrative only and not limiting as to the scope of the invention which is to be given the full breadth of the appended claims and any equivalents thereof.

What is claimed is:

1. An assembly for connecting a first pair of wires with a second pair of wires, comprising:

a first housing portion;

a second housing portion;

a third housing portion; and a pair of insulation piercing contacts;

wherein the first housing portion is moveably connected with the second housing portion and a first end of the pair of insulation piercing contacts is arranged longitudinally in a first wire receiving opening formed between the first housing portion and the second housing portion to pierce the first pair of wires when the first housing portion and the second housing portion are moved into compression upon the first pair of wires and wherein the third housing portion is moveably connected with the second housing portion and a second end of the pair of insulation piercing contacts is arranged longitudinally in a second wire receiving opening formed between the third housing portion and the second housing portion to pierce the second pair of wires when the third housing portion and the second housing portion are moved into compression upon the second pair of wires.

2. The assembly as recited in claim 1, wherein the first housing section is slidably moveable with respect to the second housing section and the third housing section is slidably moveable with respect to the second housing section.

3. The assembly as recited in claim 2, wherein the first housing section and the second housing section are lockable when compressed upon the first wire pair and the third housing section and the second housing section are lockable when compressed upon the second wire pair.

4. The assembly as recited in claim 3, wherein the first wire pair is coupled to a source of DC power and the second wire pair is coupled to a DC powered device.

5. The assembly as recited in claim 4, wherein at least one of the first wire pair and the second wire pair comprises a 2-conductor wire.

6. The assembly as recited in claim 4, wherein at least one of the first wire pair and the second wire pair comprises a twisted wire pair.

7. The assembly as recited in claim 3, wherein at least one of the first and second housing sections has a rib structure for supporting the first wire pair when the first and second housing sections are compressed.

8. The assembly as recited in claim 3, wherein at least one of the third and second housing sections has a rib structure for supporting the second wire pair when the third and second sections are compressed.

9. The assembly as recited in claim 1, wherein the pair of insulation piercing contacts each comprises a bend intermediate the first end of the pair insulation piercing contacts and the second end of the pair of insulation piercing contacts whereby the first end of the pair of insulation piercing contacts are longitudinally offset from the second end of the pair of insulation piercing contacts such that a tine of the first end of the pair of insulating piercing contacts is arranged to pierce the first pair of wires with the first pair of wires having a first gauge and a tine of the second end of the pair of insulating piercing contacts is arranged to pierce the second pair of wires with the second pair of wires having a second gauge different than the first gauge.

10. The assembly as recited in claim 9, wherein the pair of insulating piercing contacts are carried within the second housing section.

* * * * *